US009033573B2

(12) United States Patent
Kaelin et al.

(10) Patent No.: US 9,033,573 B2
(45) Date of Patent: May 19, 2015

(54) TIMEPIECE BARREL ASSEMBLY WITH REDUCED CORE DIAMETER

(75) Inventors: Laurent Kaelin, Sonvilier (CH); Baptist Wyssbrod, Nidau (CH); Arthur Queval, Lutry (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/240,975

(22) PCT Filed: Sep. 13, 2012

(86) PCT No.: PCT/EP2012/067913

§ 371 (c)(1),
(2), (4) Date: Feb. 25, 2014

(87) PCT Pub. No.: WO2013/037870

PCT Pub. Date: Mar. 21, 2013

(65) Prior Publication Data

US 2014/0211596 A1 Jul. 31, 2014

(30) Foreign Application Priority Data

Sep. 15, 2011 (EP) ..... 11181352

(51) Int. Cl.

| | |
|---|---|
| ***G04B 1/10*** | (2006.01) |
| ***G04B 1/16*** | (2006.01) |
| ***G04B 1/14*** | (2006.01) |
| ***G04B 1/18*** | (2006.01) |

(52) U.S. Cl.
CPC ..... *G04B 1/165* (2013.01); *G04B 1/145* (2013.01); *G04B 1/16* (2013.01); *G04B 1/18* (2013.01)

(58) Field of Classification Search
USPC ..... 368/139–140, 142, 144; 148/557
See application file for complete search history.

(56) References Cited

U.S. PATENT DOCUMENTS

| | | | |
|---|---|---|---|
| 182,629 | A | 9/1876 | Barclay |
| 647,760 | A | 4/1900 | Quinn |
| 647,819 | A | 4/1900 | Eagleston |
| 1,110,061 | A | 9/1914 | Kienzle |
| 2,524,660 | A | 10/1950 | Harder et al. |

(Continued)

FOREIGN PATENT DOCUMENTS

| | | |
|---|---|---|
| CH | 213484 | 2/1941 |
| CH | 279670 | 12/1951 |
| CH | 319631 | 2/1957 |
| CH | 341764 | 10/1959 |

(Continued)

OTHER PUBLICATIONS

International Search Report Issued Nov. 13, 2012 in PCT/EP12/067913 Filed Sep. 13, 2012.

*Primary Examiner* — Sean Kayes
(74) *Attorney, Agent, or Firm* — Oblon, McClelland, Maier & Neustadt, L.L.P.

(57) ABSTRACT

A timepiece barrel assembly, including a barrel mainspring mounted between a barrel drum and a receiving surface of a barrel core coaxial to the drum. The spring is made of a multiphase, cobalt-nickel-chromium based alloy, having a Young's modulus of between 200 and 240 GPa and a shear modulus of between 80 and 100 GPa, and having a width to thickness ratio of between 9 and 21, and the maximum radius of the steel or stainless steel core relative to its pivot axis is less than nine times the maximum thickness of the spring, and the barrel assembly includes, on the spring or the drum, a mechanism limiting longitudinal clearance, towards the pivot axis, between the drum and the mainspring.

15 Claims, 5 Drawing Sheets

(56) References Cited

U.S. PATENT DOCUMENTS

| | | | | |
|---|---|---|---|---|
| 3,564,839 | A | 2/1971 | Wuthrich | |
| 3,928,085 | A | 12/1975 | Yamamura et al. | |
| 8,684,594 | B2 * | 4/2014 | Murakami et al. | 368/175 |
| 2002/0191493 | A1 * | 12/2002 | Hara | 368/140 |
| 2007/0133355 | A1 * | 6/2007 | Hara et al. | 368/140 |

FOREIGN PATENT DOCUMENTS

| | | |
|---|---|---|
| CH | 568 596 | 10/1975 |
| DE | 1 984 988 | 5/1968 |
| DE | 10 2009 014 4 | 9/2010 |
| FR | 1 473 744 | 3/1967 |
| GB | 1 162 296 | 8/1969 |

* cited by examiner

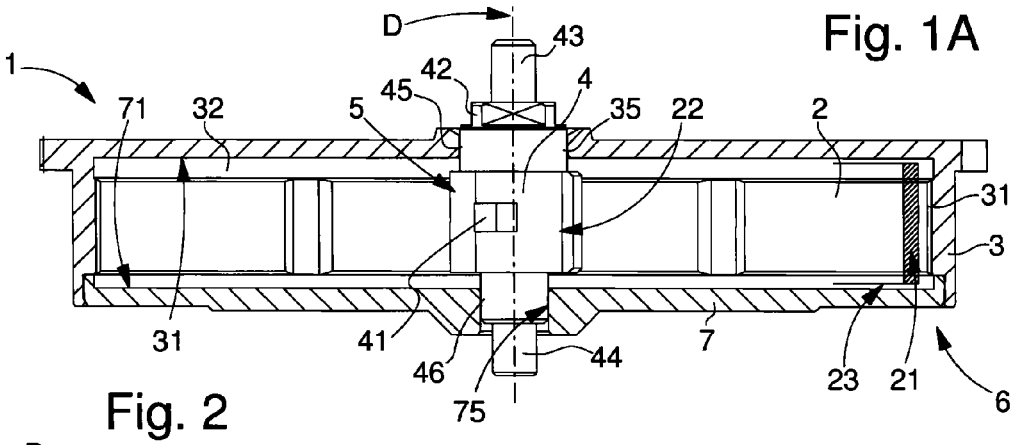
Fig. 1A
Fig. 2
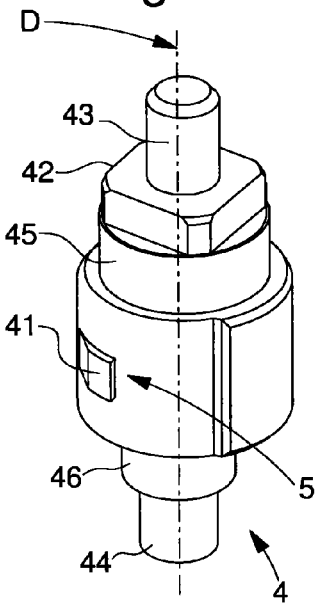
Fig. 3
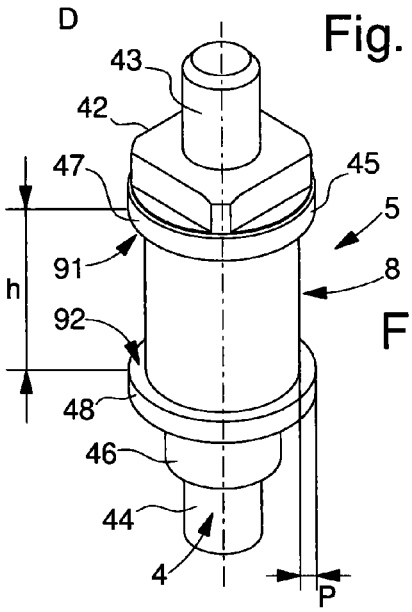
Fig. 5C Fig. 6C
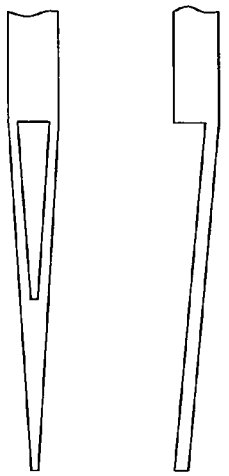
Fig. 5A Fig. 6A
Fig. 4
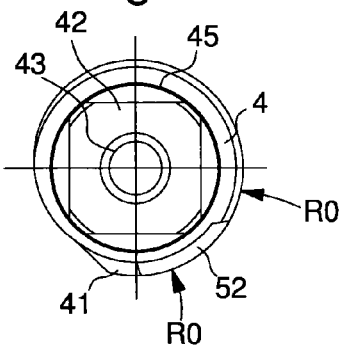
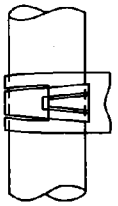
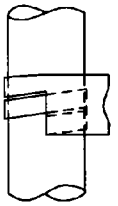
Fig. 5B Fig. 6B
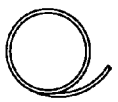
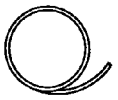

TIMEPIECE BARREL ASSEMBLY WITH REDUCED CORE DIAMETER

CROSS-REFERENCE TO RELATED APPLICATIONS

This is a National Phase Application in the United States of International Patent Application PCT/EP 2012/067913 filed Sep. 13, 2012, which claims priority on European Patent Application No. 11181352.3 of Sep. 15, 2011, the entire contents of each of which are incorporated herein by reference.

FIELD OF THE INVENTION

The invention concerns a timepiece barrel assembly including at least one mainspring for a barrel mounted between, at a first end, a barrel drum, and at a second end, a receiving surface comprised in a barrel core coaxial to said drum about a pivot axis.

The invention also concerns a timepiece movement including at least one such barrel assembly.

The invention also concerns a timepiece including at least one movement of this type, and/or at least one barrel assembly of this type.

The invention concerns the field of horology, and more specifically the field of energy storage barrels, for powering a movement, a striking work, or another timepiece function.

BACKGROUND OF THE INVENTION

In order to increase the power reserve, by increasing the number of turns of a mainspring, one solution consists in decreasing the diameter of the barrel arbour and of the associated core, so as to increase the space available for the spring inside the drum.

The ratio of the core radius to the spring thickness is usually comprised between 10 and 20 and the invention proposes to reduce this ratio to below 10, and preferably to within a range of between 5 and 10.

The sizing must not be too small; there is a risk of breakage if the core diameter is too small.

In the conventional barrel architecture, a ratchet is axially mounted on a barrel arbour or on a core, via a square, with the ratchet usually being secured by an axial screw. The dimension of this screw and that of the square thus define the minimum diameter of a pivot shoulder. A step joined to this pivot shoulder limits the axial clearance of the arbour or of the core relative to a bottom plate or to a bridge carrying a jewel or similar element.

An even larger diameter than that of the step is required for a shoulder pivotally guiding the drum on the arbour or on the core, combined with a step limiting the axial clearance of the drum. The dimension chain required to observe minimal sections of material results in substantial dimensions, which are difficult to reduce. In particular, it is not sufficient merely to reduce all of the dimensions, since the cross-sections of material are then insufficient to ensure fatigue resistance.

CH Patent No 319631 in the name of FELSA SA discloses a double barrel, and the manner in which the clearance of each drum is limited. The clearance of the bottom drum is limited on the top side by the collar of a sleeve, which is pushed towards a shoulder of the barrel arbour, by a nut screwed onto the arbour; and, on the bottom side, by the base of a core pivoting integrally with the barrel arbour via a flat portion. The length of the bottom shoulder of the barrel arbour and that of the drum pipe determine the drum clearance, in relation to these collar and base surfaces.

U.S. Pat. No. 1,110,061 in the name of KIENZLE discloses a core detachably mounted on a barrel arbour (in the direction of pivoting); the core is supported both on the plate and the bridge, while the two shoulders of the core limit the travel of the drum and of the cover.

U.S. Pat. No. 3,564,839 in the name of WUTHRICH discloses a barrel which includes a screw thread on the bridge for supporting the drum, and a drum having a pipe. The cover is a simple metal plate placed on the bottom plate, with no connection to the arbour or to the drum. The arbour includes two shoulders, one resting on the core, the other intended to cooperate in abutment with the drum pipe.

GB Patent No 1162296 in the name of CITIZEN discloses a spring of variable thickness, but there is no teaching concerning the height features of the spring.

CH Patent No 341764 in the name of AUGE discloses a spring with strips of different widths, welded to each other.

All of these documents disclose barrel arbours with a hook driving the spring, but none with a pivoting barrel arbour for receiving the spring. The documents do not particularly describe any recess, on the arbour or the core, in which the spring could be positioned. Some Patent documents disclose springs whose rigidity is modified on the inner end coil, by modifying its thickness or otherwise; the geometry of the spring is not taken into account for centring the spring.

SUMMARY OF THE INVENTION

As a result of these physical limitations on the dimensioning of the various components, it is necessary to envisage different barrel architectures from the conventional architecture that has just been described.

The invention takes account of several solutions to arrive at this decrease in core diameter.

A significant constraint is ensuring that the assembly can be dismantled to change the mainspring or the entire barrel, if necessary.

The various means proposed by the invention can be combined with each other, to obtain an optimum result according to the space available, the position of the ratchet, the presence or absence of a cover for closing the barrel, although this function can also be performed by the ratchet.

A first solution consists in providing for the clearance between the drum and cover by the mainspring, by transferring the clearance adjustment function to the spring, in particular by fitting the spring with projecting areas, such as lugs, wider laminated areas, adding a flange, or similar. It is then possible to do without the shoulders supporting the drum and the cover on the barrel arbour or on the core.

A second solution consists in forming a core in several parts, particularly in two or three parts. This solution notably makes it possible to form a core of smaller diameter than the pivoting diameter of the drum. Advantageously, the core is inserted through the bore in the drum. An arbour or a core in two or more parts facilitates the machining of the hook for hooking the mainspring eye.

The core may include, for driving the ratchet, a conventional square or a threading. Or, in a non-limiting manner, in a second variant, the core may also include one or more diameter adjustment washers or rings for guiding the core inside the plate and bridge.

Another solution consists in driving a washer onto the core to adjust the drum-cover clearance. This ring is mounted so as to prevent any disassembly of a bridge, when intervention is required on the barrel.

Yet another solution consists in providing for the pivoting of the drum and/or the cover in the bridges, instead of pivoting occurring on the barrel arbour or the core. Advantageously, both the drum and the cover are pivoted in a plate and a bridge.

The different variants proposed by the invention ensure ease of machining, assembly and disassembly, and control of the axial clearances between the various components and relative to the bridges.

In a particular version, the invention concerns a timepiece barrel assembly, including at least one mainspring mounted between, at a first end, a barrel drum, and at a second end, a receiving surface comprised in a barrel core coaxial to said drum about a pivot axis, characterized in that said spring is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa, and having a width to thickness ratio of between 9 and 21, and in that the maximum radius of said steel or stainless steel core relative to said pivot axis is less than nine times the maximum thickness of said spring, and further characterized in that said barrel assembly includes, on said spring or said drum, a means of limiting the longitudinal clearance, in the direction of said pivot axis, between said drum and said mainspring.

According to a feature of the invention, said means of limiting the longitudinal clearance between said drum and said spring is formed, either by at least one lug on at least one of the edges of said spring, or by a peripheral recess comprised in said drum on its largest internal diameter, said peripheral recess being comprised between two oblique shoulders for supporting and peripherally holding said spring.

The invention also concerns a timepiece movement including at least one barrel assembly of this type for storing energy with one input formed either by a ratchet mounted for integral rotation with said core, or by a drum toothing mounted for integral rotation with said drum, and an output respectively formed either by a drum toothing mounted for integral rotation with said drum, or by a ratchet mounted for integral rotation with said core.

The invention concerns a timepiece including at least one timepiece movement of this type and/or at least one energy storage assembly of this type with one input formed either by a ratchet mounted for integral rotation with said core, or by a drum toothing mounted for integral rotation with said drum, and an output formed respectively either by a drum toothing mounted for integral rotation with said drum, or by a ratchet mounted for integral rotation with said core.

BRIEF DESCRIPTION OF THE DRAWINGS

Other features and advantages of the invention will appear more clearly upon reading the following detailed description, with reference to the annexed drawings, in which:

FIG. 1A shows a schematic cross-section of a barrel according to the invention in a plane passing through the pivot axis thereof.

FIG. 2 shows a schematic, perspective view of a variant of a core of the invention.

FIG. 3 shows a schematic, perspective view of a variant of the core according to the invention, including a recess for holding the mainspring.

FIG. 4 shows a schematic top view of the core of FIG. 2.

FIGS. 5A, 5B and 5C show schematic, respectively elevation, cross-section and plan views of a core with a friction mounted spring, and the end of the spring shown flat.

FIGS. 6A, 6B and 6C show schematic, respectively elevation, cross-section and plan views of a core with another type of friction mounted spring, and the end of the spring shown flat.

DETAILED DESCRIPTION OF PREFERRED EMBODIMENTS

Figure 1:
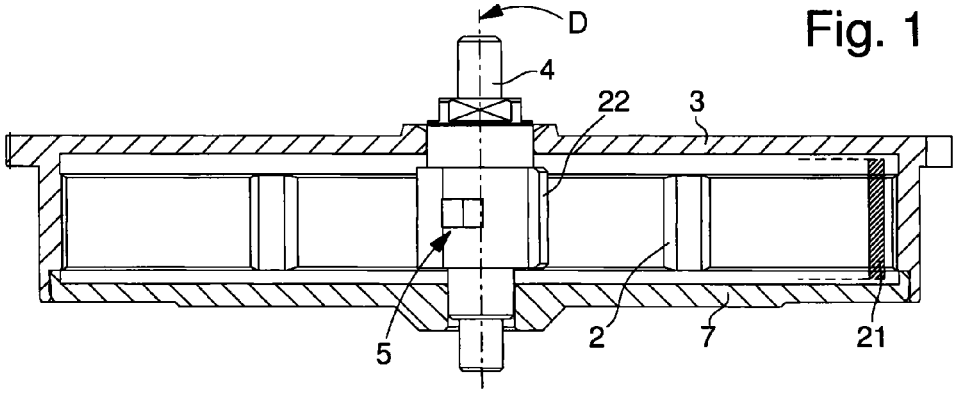
FIG. 1 shows a schematic cross-section of a timepiece barrel in a plane passing through the pivot axis thereof.

The invention concerns the field of horology, and more specifically the field of energy storage barrels, for powering a movement, a striking work, or another timepiece function.

More specifically, the invention concerns a barrel for a mechanical watch having a reduced core diameter.

In a particular version, the invention concerns a timepiece barrel assembly 1, including at least one barrel mainspring 2. This spring 2 is conventionally mounted between, at a first end 21, a barrel drum 3, and at a second end 22, a receiving surface 5 comprised in a barrel core 4 coaxial to drum 3 about a pivot axis D.

According to the invention, spring 2 is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa.

This spring 2 has a width to thickness ratio comprised between 3 and 23, and more particularly between 9 and 21.

The maximum radius of steel or stainless steel core 4 relative to pivot axis D is less than nine times the maximum thickness of spring 2.

Barrel assembly 1 includes, on spring 2 or on drum 3, a means 6 of limiting the longitudinal clearance towards pivot axis D, between drum 3 and mainspring 2.

Figure 8:
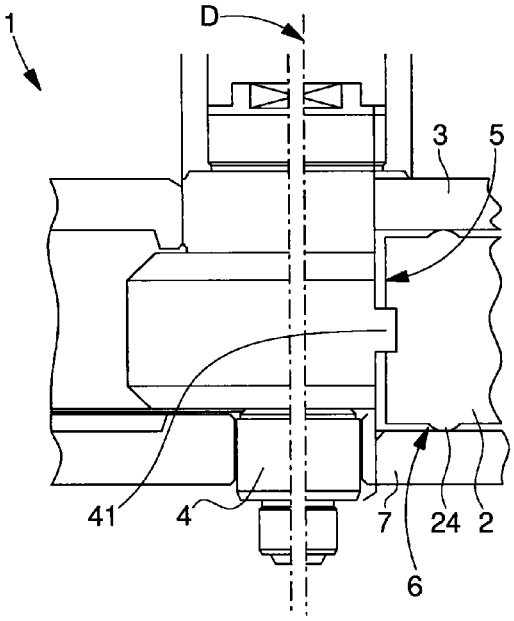
FIG. 8 shows a schematic, partial cross-section of the right portion of a barrel of the invention in a plane passing through the pivot axis, with a spring fitted with lugs according to the invention.
Figure 8A:
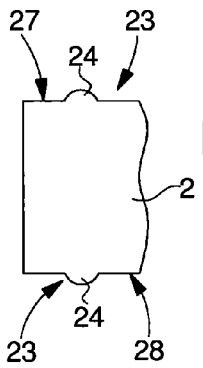
FIG. 8A shows a detail of the spring shown flat.

In a particular variant, as seen in FIGS. 8 and 8A, spring 2 advantageously includes at least one projecting area 23 arranged for cooperating in abutment with an inner face 31 of drum 3 and/or with an inner face 71 of a cover 7 delimiting, with drum 3, a chamber 32 housing spring 2.

As seen in FIG. 8A, in a first variant, this projecting area 23 includes at least one lug 24 on at least one of the edges 27; 28 of spring 2. This projecting area 23 is arranged for cooperating with an inner surface 31 of drum 3, and/or with an inner surface 71 of cover 7, and preferably with both.

According to a particular feature of the invention, means 6 of limiting the longitudinal clearance between drum 3 and spring 2 is thus formed, either by at least one lug 24 on at least one of edges 27, 28 of spring 2, or by a peripheral recess 36 comprised in drum 3 on its largest inner diameter, peripheral recess 36 being comprised between two oblique shoulders 33, 34 for the peripheral holding and support of spring 2.

Figure 1B:
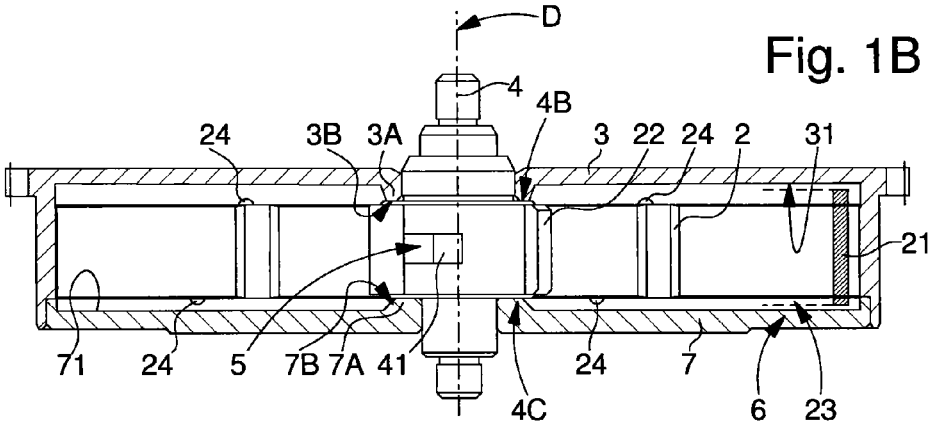
FIG. 1B shows a schematic cross-section of another barrel variant according to the invention in a plane passing through the pivot axis thereof.

In a preferred embodiment, seen in FIGS. 1A and 1B, spring 2 is confined inside a chamber 32 delimited by drum 3 and a cover 7, and barrel assembly 1 according to the invention includes, located elsewhere than on core 4, a means 6 of adjusting the longitudinal clearance towards pivot axis D between cover 7 and spring 2.

According to a particular feature of the invention, this at least one lug 24 of spring 2 is arranged for cooperating in abutment with an inner face 31 of drum 3 and/or with an inner face 71 of a cover 7 delimiting, with drum 3, a chamber 32 housing spring 2.

Figure 10:
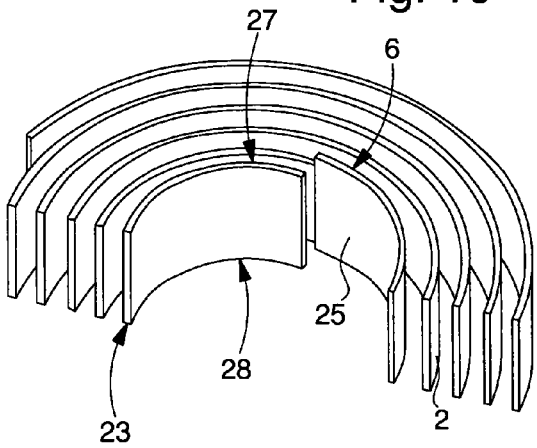
FIG. 10 shows a detail of the spring.
Figure 9:
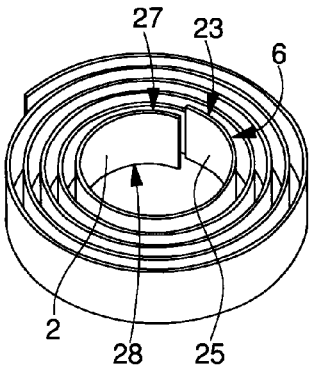
FIG. 9 shows a schematic perspective view of a spring of the invention with protruding, wider local rolling.

According to a particular feature of the invention, in another variant visible in FIG. 9 or 10, this projecting area 23, or in particular this lug 24, includes at least one height extended coil of spring 2.

Figure 12:
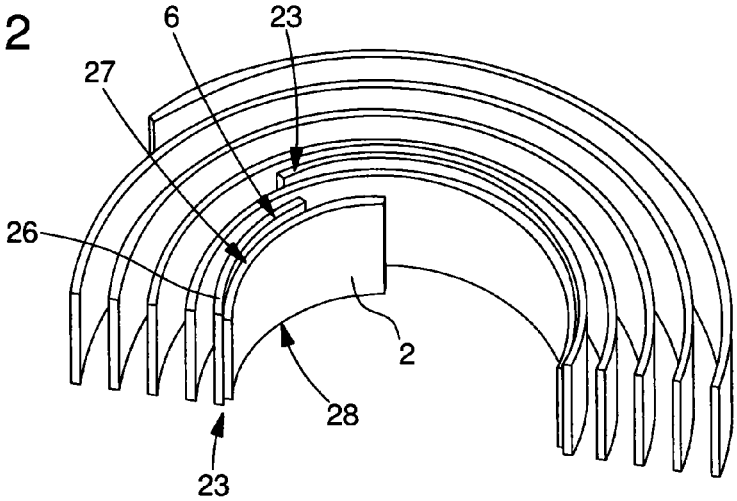
FIG. 12 shows a detail of the spring.
Figure 11:
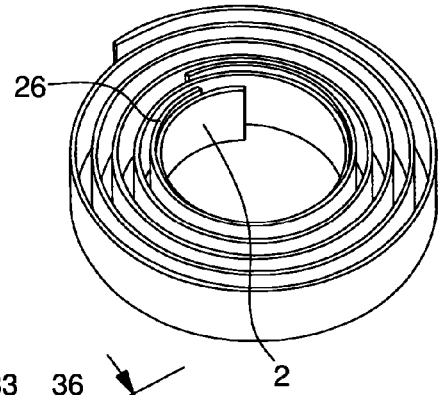
FIG. 11 shows a schematic perspective view of a spring of the invention with a protruding added flange.

In yet another variant, visible in FIGS. 11 and 12, this projecting area 23, or in particular this lug 24, includes at least one added flange 26, of greater height locally than that of the coils of spring 2, and which is fixed to the spring, for example by welding.

Figure 13:
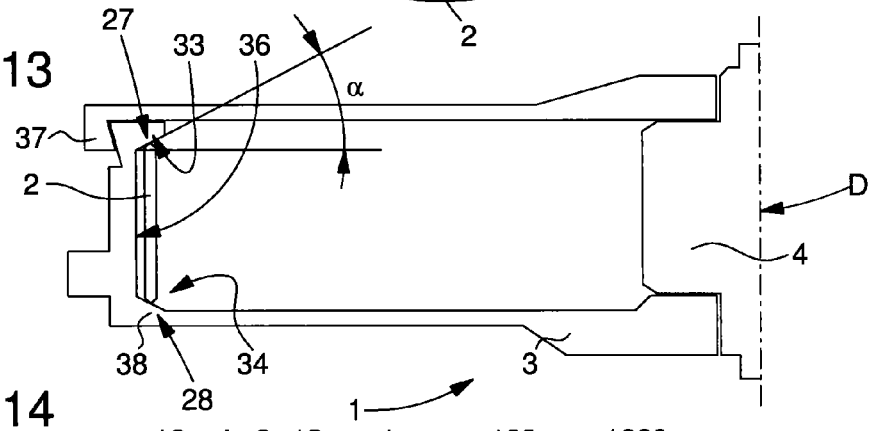
FIG. 13 shows a schematic, partial cross-section of a barrel of the invention, in a plane passing through the pivot axis, with a particular arrangement of the largest diameter of the barrel as regards the external spring receiving surface.
Figure 14:
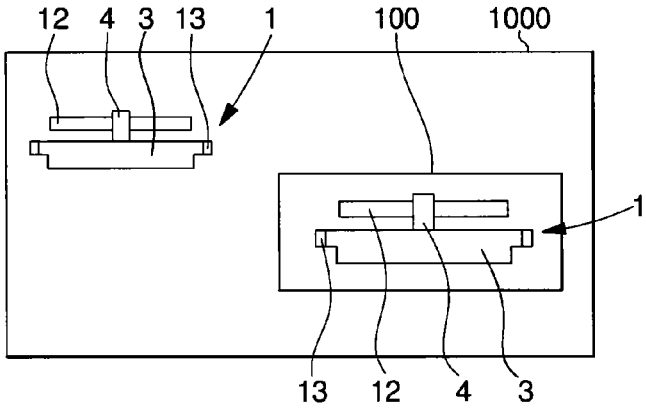
FIG. 14 shows block diagrams of a timepiece movement including a barrel assembly according to the invention, and a timepiece including the movement and a barrel assembly according to the invention.
Figure 16:
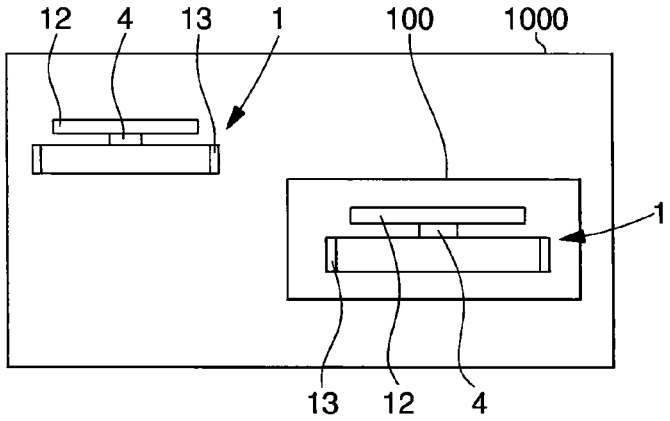
FIG. 16 shows block diagrams of a timepiece movement including a barrel assembly according to the invention and a timepiece including the movement and a barrel assembly according to the invention.

In the particular embodiment of FIG. 13, drum 3 includes, on its largest inner diameter, a peripheral recess 36 comprised between two top and bottom collars 37 and 38 whose top edge 27 and bottom edge 28, respectively carry two oblique shoulders 33 and 34 at an angle α, for the peripheral holding and support of spring 2. In a variant of this type, means 6 of limiting the longitudinal clearance between drum 3 and spring 2 is formed by a peripheral recess 36 comprised in drum 3 on its largest inner diameter, this peripheral recess 36 being comprised between two shoulders 33, 34 for the peripheral holding and support of spring 2.

Figure 7:
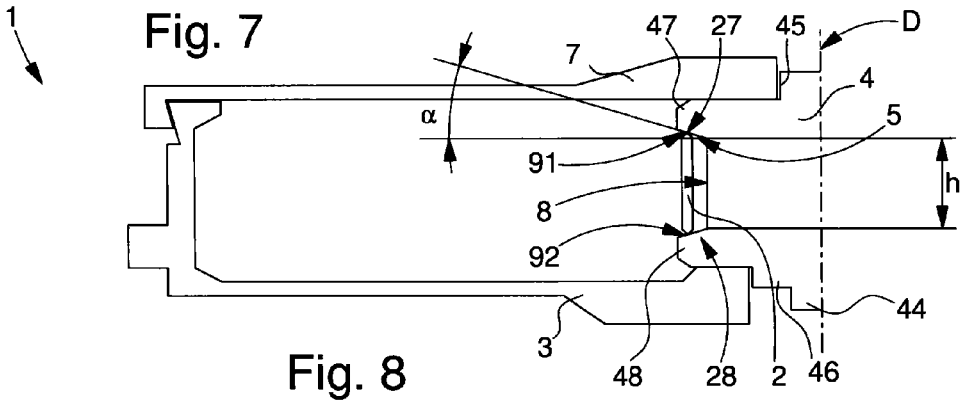
FIG. 7 shows a schematic, partial cross-section of a barrel of the invention, in a plane passing through the pivot axis, with a particular arrangement of the core as regards the inner spring receiving surface.

It is easy to combine the embodiments of FIGS. 7 and 13 and the combination ensures a good holding of spring 2. In the preferred case where the spring has a projecting area 23, one side of area 23 is fixed relative to drum 3 and/or cover 7, which ensures perfect adjustment of the clearance.

In a variant, peripheral recess 36 is cylindrical and has the same height as spring 2, which is centred between shoulders 33, 34 which are plane and perpendicular to pivot axis D.

According to another particular feature of the invention, peripheral recess 36 has a lower height than that of spring 2, which is centred supported obliquely between shoulders 33, 34, which include oblique faces facing each other so as to define a V-shaped support for edge surfaces 27, 28 comprised in spring 2.

According to a particular feature of the invention, spring 2 is elastically held with no hook around receiving surface 5 which is a surface of revolution relative to pivot axis D.

FIGS. 2 and 3 show a core contained within an envelope of radius RO about axis D. The receiving surface 5 includes a hook 41 for hooking the eye of spring 2; a recess 52 allows spring 2 to be hooked and facilitates the machining of hook 41. Shoulders 43 and 44 are arranged for cooperating with jewels mounted in plates or bridges of the movement receiving barrel assembly 1. Square 42 is arranged for hooking a ratchet 12. Shoulders 45 and 46 respectively cooperate with a bore 35 of drum 3 and a bore 75 of cover 7.

Figure 15A:
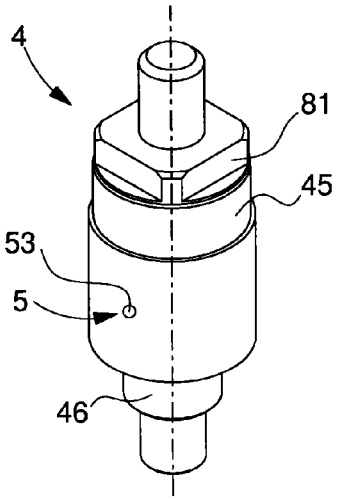
FIGS. 15A, 15B, 15C show perspective views of different variants of a core according to the invention arranged for welding the mainspring.
Figure 15B:
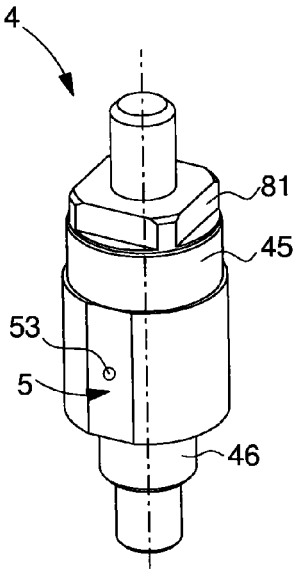
Figure 15C:
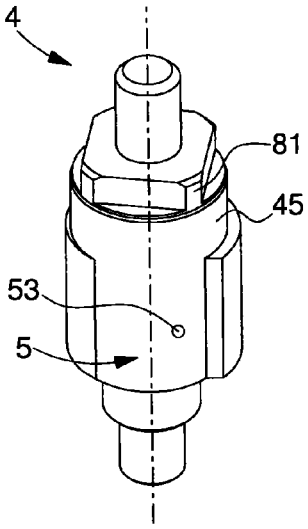

In a particular embodiment, seen in FIGS. 3, 15A, 15B, 15C, receiving surface 5 is a surface of revolution relative to pivot axis D. Preferably, this receiving surface is a contact surface for fixing spring 2 by welding to core 4, by a point 53 or along a segment, preferably parallel to pivot axis D, passing through point 53, as seen in FIGS. 15A, 15B, 15C.

In the case of FIG. 15A, spring 2 is supported on point 53 on a cylindrical portion of core 4 of small width. In the case of FIG. 15B, spring 2 is supported on point 53 on a flat portion tangential to one of shoulders 45 or 46 supporting drum 3 or cover 7, preferably to shoulder 45 here intended to cooperate with bore 35 of drum 3. FIG. 15C illustrates a cylindrical bearing surface of spring 2, wider that that of FIG. 15A, and which is locally merged with one of shoulders 45 or 46 for supporting drum 3 or cover 7, preferably with shoulder 45 here intended to cooperate with bore 35 of drum 3. In a particular variant of FIG. 15C, spring receiving surface 5 has, from weld point 53 or from a weld segment passing through point 53 and parallel to pivot axis D, a helical section, so that after the first rotation, the spring is superposed on itself without any inflection or break in the gradient.

In a particular embodiment seen in FIG. 3, the surface of revolution 5 is formed by a recess 8 of height h comprised between two shoulders 91, 92 belonging to collars 47, 48. These shoulders 91 and 92 define the maximum radius of core 4 relative to pivot axis D. Preferably, recess 8 is cylindrical and has the same height as spring 2, which is centred between shoulders 91, 92, which are plane and perpendicular to pivot axis D.

Advantageously, recess 8 has a depth P corresponding to two times the thickness of spring 2.

In another variant illustrated in FIG. 7, recess 8 has a height h lower than that of spring 2 which is centred supported obliquely between shoulders 91, 92 of a top collar 47 and a bottom collar 48. These collars 91 and 92 include oblique faces inclined at an angle α facing each other to define a V-shaped support for edge surfaces 27 and 28 of spring 2.

FIG. 1B illustrates an embodiment wherein the drum has a shoulder 3A facing spring 2, and be supported via a bearing surface 3B on a bearing surface 4B comprised in core 4, and wherein cover 7 has a shoulder 7A facing spring 2, and can be supported via a bearing surface 7B on a bearing surface 4C comprised in core 4.

As seen in particular, but in a non-limiting manner, in the variants of FIGS. 5A, 5B, 5C, 6A, 6B, 6C, barrel assembly 1 has a spring 2 which is fixed by friction to core 4, the end of spring 2 then preferably includes a shoulder devised for keeping the free end of spring 2 arched when it is wound.

In other embodiments, spring 2 forms, with core 4, a single-piece, welded or soldered or similar spring-core subassembly. This embodiment is particularly advantageous, economical and very easy to assemble.

The invention also concerns a timepiece movement 100 including at least one barrel assembly 1 of this type for storing energy with one input formed either by a ratchet 12 mounted for integral rotation with core 4, or by a drum toothing 13 mounted for integral rotation with drum 3, and an output respectively formed either by a drum toothing 13 mounted for integral rotation with drum 3, or by a ratchet 12 mounted for integral rotation with core 4.

The invention concerns a timepiece 1000 including at least one timepiece movement 100 and/or at least one barrel assembly for energy storage with one input formed either by a ratchet 12 mounted for integral rotation with core 4, or by a drum toothing 13 mounted for integral rotation with drum 3, and an output formed respectively either by a drum toothing 13 mounted for integral rotation with drum 3, or by a ratchet 12 mounted for integral rotation with core 4.

The invention claimed is:

1. A timepiece barrel assembly, comprising:

at least one barrel mainspring mounted between, at a first end a barrel drum, and at a second end, a receiving surface comprised in a barrel core coaxial to the drum about a pivot axis;

wherein the mainspring is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa, and having a width to thickness ratio of between 9 and 21, wherein the barrel core is a steel or stainless steel core having a maximum radius relative to the pivot axis less than nine times a maximum thickness of the mainspring, and wherein the barrel assembly includes, on the mainspring or the drum, a means for limiting longitudinal clearance, in a direction of the pivot axis, between the drum and the mainspring.

2. The barrel assembly according to claim 1, wherein the means for limiting the longitudinal clearance between the drum and the mainspring is formed, either by at least one lug on at least one of edges, of the mainspring, or by a peripheral recess comprised in the drum on a largest inner diameter thereof, the peripheral recess being comprised between two oblique shoulders for peripheral holding and support of the mainspring.

3. The barrel assembly according to claim 2, wherein the at least one lug of the mainspring is arranged for cooperating in abutment with an inner face of the drum and/or with an inner face of a cover delimiting, with the drum, a chamber for housing the mainspring.

4. The barrel assembly according to claim 3, wherein the lug includes at least one height extended coil of the mainspring.

5. The barrel assembly according to claim 3, wherein the lug includes at least one added flange, of greater height locally than that of the mainspring and fixed to the mainspring.

6. The barrel assembly according to claim 2, wherein the means for limiting the longitudinal clearance between the drum and the mainspring is formed by a peripheral recess comprised in the drum on the largest inner diameter thereof, the peripheral recess being comprised between the two shoulders for the peripheral holding and support of the mainspring.

7. The barrel assembly according to claim 6, wherein the peripheral recess is cylindrical and has a same height as the mainspring which is centered between the shoulders which are plane and perpendicular to the pivot axis.

8. The barrel assembly according to claim 6, wherein the peripheral recess has a lower height than that of the mainspring, which is centered, supported obliquely between the shoulders, which include oblique faces facing each other to define a V-shaped support for edge surfaces comprised in the mainspring.

9. The barrel assembly according to claim 1, wherein the mainspring is elastically held with no hook around the receiving surface which is a surface of revolution relative to the pivot axis.

10. The barrel assembly according to claim 9, wherein the surface of revolution is formed by a recess comprised between two shoulders which define a maximum radius of a core relative to the pivot axis.

11. The barrel assembly according to claim 10, wherein the recess has a lower height than that of the mainspring which is centered, supported obliquely between the shoulders, which include oblique faces facing each other and defining a V-shaped support for edge surfaces comprised in the mainspring.

12. The barrel assembly according to claim 1, wherein the mainspring is fixed by friction to the core.

13. The barrel assembly according to claim 1, wherein the mainspring forms, with the core, a welded or soldered single-piece spring-core sub-assembly.

14. A timepiece movement including at least one barrel assembly according to claim 1 for storing energy with one input formed either by a ratchet mounted for integral rotation with the core, or by a drum toothing mounted for integral rotation with the drum, and an output respectively formed either by a drum toothing mounted for integral rotation with the drum, or by a ratchet mounted for integral rotation with the core.

15. A timepiece including at least one timepiece movement according to claim 14.

* * * * *